US010449409B2

(12) United States Patent
Hamilton et al.

(10) Patent No.: US 10,449,409 B2
(45) Date of Patent: Oct. 22, 2019

(54) STOWABLE ROWING MACHINE

(71) Applicant: Nautilus, Inc., Vancouver, WA (US)

(72) Inventors: Bryan W. Hamilton, Vancouver, WA (US); John P. Shepard, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 120 days.

(21) Appl. No.: 15/344,219

(22) Filed: Nov. 4, 2016

(65) Prior Publication Data

US 2018/0126216 A1 May 10, 2018

(51) Int. Cl.
*A63B 22/00* (2006.01)
*A63B 21/008* (2006.01)
(Continued)

(52) U.S. Cl.
CPC ..... *A63B 22/0076* (2013.01); *A63B 21/0051* (2013.01); *A63B 21/0088* (2013.01);
(Continued)

(58) Field of Classification Search
CPC ..... A63B 22/0076; A63B 21/012; A63B 21/0125; A63B 21/015; A63B 21/0618; A63B 21/068; A63B 21/15; A63B 21/159; A63B 21/4027; A63B 21/4029; A63B 21/4031; A63B 21/4041; A63B 21/4045; A63B 22/0046; A63B 22/0087; A63B 22/20; A63B 22/201; A63B 22/203; A63B 22/208; A63B 2022/0079; A63B 2022/0082; A63B 2022/0084; A63B 2022/206; A63B 69/06; A63B 2069/062; A63B 2069/064; A63B 2069/066; A63B 2069/068; A63B 71/0054; A63B 2071/0063; A63B 2071/0072; A63B 2071/0081; A63B 2071/009;
(Continued)

(56) References Cited

U.S. PATENT DOCUMENTS 3,898,950 A 8/1975 Martin
4,284,272 A 8/1981 Evans et al.
(Continued)

FOREIGN PATENT DOCUMENTS

CN 201603338 10/2010
CN 202185108 4/2012
(Continued)

*Primary Examiner* — Gary D Urbiel Goldner
(74) *Attorney, Agent, or Firm* — Dorsey & Whitney LLP

(57) ABSTRACT

A stowable rowing machine is provided. The stowable rowing machine may include a frame, a seat rail selectively movable relative to the frame between storage and use configurations, and an adjustment assembly movably coupling the seat rail to the frame and operable to releasably secure the seat rail to the frame. The adjustment assembly may include a plurality of securing elements configured to selectively engage the seat rail to secure the seat rail in position. The adjustment assembly may include a plurality of guide elements configured to selectively engage the seat rail, the plurality of guide elements including at least one disengagement guide element. When the seat rail is engaged with the disengagement guide element(s), the seat rail may be disengaged from the securing elements.

19 Claims, 11 Drawing Sheets

(51) Int. Cl.
*A63B 21/005* (2006.01)
*A63B 21/012* (2006.01)
*A63B 21/22* (2006.01)
*A63B 21/00* (2006.01)

(52) U.S. Cl.
CPC ..... *A63B 21/012* (2013.01); *A63B 21/151* (2013.01); *A63B 21/225* (2013.01); *A63B 2022/0079* (2013.01); *A63B 2210/50* (2013.01)

(58) Field of Classification Search
CPC ..... A63B 2210/00; A63B 2210/50; A63B 2225/09; A63B 2225/093
See application file for complete search history.

(56) References Cited

U.S. PATENT DOCUMENTS 4,346,886 A 8/1982 Cox et al.
4,396,188 A 8/1983 Dreissigacker et al.
4,421,307 A 12/1983 Cunnington et al.
4,477,071 A 10/1984 Brown et al.
4,541,627 A 9/1985 MacLean et al.
4,563,000 A 1/1986 Gall
4,572,500 A 2/1986 Weiss
D286,311 S 10/1986 Martinell et al.
4,647,035 A 3/1987 Yellen
4,650,181 A 3/1987 Yang
4,674,741 A 6/1987 Pasierb, Jr. et al.
4,690,398 A 9/1987 Smith
4,695,050 A 9/1987 Smith et al.
4,714,244 A 12/1987 Kolomayets et al.
4,722,520 A 2/1988 Lee
4,723,774 A 2/1988 Monforte
4,735,410 A 4/1988 Nobuta
4,736,944 A 4/1988 Johnson et al.
4,743,010 A 5/1988 Geraci
4,743,011 A 5/1988 Coffey
4,746,112 A 5/1988 Fayal
4,756,523 A 7/1988 Rasmussen
4,768,775 A 9/1988 Marshall
4,768,776 A 9/1988 Giannotti
4,772,013 A 9/1988 Tarlow, Jr. et al.
4,795,147 A 1/1989 Seal
4,798,378 A 1/1989 Jones
4,813,667 A 3/1989 Watterson
4,822,032 A 4/1989 Whitmore et al.
4,846,460 A 7/1989 Duke
4,867,447 A 9/1989 Johnson
4,880,224 A 11/1989 Jonas et al.
4,883,268 A 11/1989 Salkind
4,884,800 A 12/1989 Duke
4,921,242 A 5/1990 Watterson
4,930,769 A 6/1990 Nenoff
4,943,051 A 7/1990 Haskins et al.
4,974,832 A 12/1990 Dalebout
4,976,423 A 12/1990 Routti
4,997,181 A 3/1991 Lo
5,013,033 A 5/1991 Watterson et al.
5,072,929 A 12/1991 Peterson et al.
5,092,581 A 3/1992 Koz
5,094,446 A 3/1992 Wiedner
5,104,363 A 4/1992 Shi
5,108,093 A 4/1992 Watterson
5,122,105 A 6/1992 Engel et al.
D337,799 S 7/1993 Cutter et al.
5,295,931 A 3/1994 Dreibelbis et al.
D352,534 S 11/1994 Dreibelbis et al.
5,370,593 A 12/1994 Wang
5,382,210 A 1/1995 Rekers
5,441,469 A 8/1995 Chern
5,470,295 A 11/1995 Wang
D367,508 S 2/1996 Dreissigacker et al.
5,569,130 A 10/1996 Wang et al.
5,616,105 A 4/1997 Wang et al.
5,645,514 A 7/1997 Chen
5,658,225 A 8/1997 Huang
5,707,322 A 1/1998 Dreissigacker et al.
5,779,600 A 7/1998 Pape
5,865,713 A 2/1999 Hsu
5,899,780 A 5/1999 Robbins
5,916,069 A 6/1999 Wang et al.
6,071,215 A 6/2000 Raffo et al.
6,168,554 B1 1/2001 Berg et al.
6,206,808 B1 3/2001 Ho
6,231,485 B1 5/2001 Dreissigacker et al.
6,371,892 B1 4/2002 Dreissigacker et al.
6,561,955 B1 5/2003 Dreissigacker et al.
6,565,489 B2 5/2003 Ho et al.
6,602,168 B2 8/2003 Duke
6,682,462 B1 1/2004 Lee
6,695,753 B2 2/2004 Ho et al.
6,749,546 B2 6/2004 Yang
6,926,647 B1 8/2005 Huang et al.
6,960,156 B2 11/2005 Smith
6,981,932 B1 1/2006 Huang et al.
6,991,589 B1 1/2006 Patterson
7,022,052 B1 4/2006 Lai
7,108,639 B2 9/2006 Smith et al.
7,115,077 B2 10/2006 Yang
7,141,008 B2 11/2006 Krull et al.
7,201,708 B2 4/2007 Dreissigacker et al.
7,204,790 B2 4/2007 Sleamaker
7,226,397 B1 6/2007 MacDonald et al.
7,229,388 B2 6/2007 Yang
7,270,630 B1 9/2007 Patterson
7,361,124 B1 4/2008 Chung-Ting
7,381,164 B2 6/2008 Smith et al.
7,500,938 B2 3/2009 Fan
7,572,211 B2 8/2009 Roach
7,585,263 B2 9/2009 Brown et al.
7,708,670 B2 5/2010 Bowser
7,731,637 B2 6/2010 D'Eredita
7,766,802 B2 8/2010 Webber et al.
7,815,552 B2 * 10/2010 Dibble ..... A63B 21/045 482/103
7,862,484 B1 1/2011 Coffey
7,946,964 B2 5/2011 Gothro et al.
7,988,601 B2 8/2011 Bowser
8,038,582 B2 10/2011 Edmonson
8,070,657 B2 12/2011 Loach
8,192,332 B2 6/2012 Baker et al.
8,235,874 B2 8/2012 D'Eredita
8,608,626 B2 12/2013 Campbell
8,622,876 B2 1/2014 Kelliher
8,771,151 B2 7/2014 Larsson
8,944,969 B2 2/2015 Giannelli
9,005,086 B1 4/2015 O'Neil
9,028,374 B1 5/2015 Brady
9,750,972 B1 * 9/2017 Liu ..... A63B 22/0087
9,770,622 B2 9/2017 Campanaro et al.
2001/0008861 A1 7/2001 Dreissigacker et al.
2002/0022558 A1 2/2002 Casey
2002/0115537 A1 8/2002 Lin
2003/0166438 A1 9/2003 Gramaccioni
2005/0101450 A1 5/2005 Gramaccioni
2005/0130810 A1 6/2005 Sands
2005/0272568 A1 12/2005 Wang et al.
2005/0277521 A1 12/2005 Lat
2006/0100069 A1 * 5/2006 Dibble ..... A63B 21/045 482/98
2006/0116249 A1 * 6/2006 Dibble ..... A63B 21/045 482/72
2006/0264128 A1 11/2006 Osten
2006/0270528 A1 11/2006 Lai
2007/0082793 A1 4/2007 Yang
2007/0191189 A1 * 8/2007 Hsu ..... A63B 22/0056 482/53
2008/0261782 A1 10/2008 Campbell
2010/0009816 A1 1/2010 Edmondson
2011/0028278 A1 2/2011 Roach
2011/0065554 A1 * 3/2011 Van Straaten ..... A63B 21/0552 482/130
2011/0082015 A1 4/2011 Dreissigacker et al.
2012/0065034 A1 3/2012 Loach

(56) References Cited

U.S. PATENT DOCUMENTS

| | | | | |
|---|---|---|---|---|
| 2012/0100965 | A1 | 4/2012 | Dreissigacker et al. | |
| 2012/0225753 | A1 | 9/2012 | Lim | |
| 2013/0130206 | A1 | 5/2013 | Smith | |
| 2013/0296137 | A1 | 11/2013 | Liang et al. | |
| 2014/0243163 | A1 | 4/2014 | Edmondson | |
| 2014/0141941 | A1 | 5/2014 | Giannelli | |
| 2014/0336011 | A1 | 11/2014 | Singh | |
| 2015/0202484 | A1 | 7/2015 | Lalaoua | |
| 2015/0258366 | A1 | 9/2015 | Domeika et al. | |
| 2016/0001123 | A1 | 1/2016 | Parrish, Jr. | |
| 2016/0059069 | A1 | 3/2016 | Jeremic et al. | |
| 2016/0144223 | A1* | 5/2016 | Dalebout ..... | A63B 22/0076 482/72 |
| 2017/0043208 | A1* | 2/2017 | Lonergan ..... | A63B 22/0076 |
| 2018/0056117 | A1 | 3/2018 | Hamilton | |

FOREIGN PATENT DOCUMENTS

| | | | |
|---|---|---|---|
| CN | 205494791 | | 8/2016 |
| CN | 207384713 | | 5/2018 |
| CN | 207605300 | | 7/2018 |
| DE | 3625159 | A1 | 2/1987 |
| DE | 3943391 | A1 | 8/1990 |
| ES | 1187316 | | 7/2017 |
| GB | 1101009 | A | 1/1968 |
| GB | 2327621 | A | 2/1999 |
| WO | 8002647 | A1 | 12/1980 |
| WO | 8704358 | A1 | 7/1987 |
| WO | 9014132 | A1 | 11/1990 |
| WO | 9722389 | A1 | 6/1997 |
| WO | 0076592 | A1 | 12/2000 |
| WO | 2005025685 | A1 | 3/2005 |
| WO | 2009097452 | A1 | 8/2009 |
| WO | 2011056210 | A1 | 5/2011 |
| WO | 2013006145 | A1 | 1/2013 |
| WO | 2014179866 | A1 | 11/2014 |
| WO | 2014196870 | A1 | 12/2014 |
| WO | 2015054618 | A1 | 4/2015 |

* cited by examiner

STOWABLE ROWING MACHINE

TECHNICAL FIELD

The present disclosure relates generally to physical fitness and personal training and more specifically to a stowable rowing machine.

BACKGROUND

Various devices and systems exist to perform a variety of fitness training exercises. As an example, rowing machines or rowers exist to work the cardiovascular system and/or strength endurance of a user as part of a strength or fitness program. These rowing machines, however, can be bulky, difficult to adjust, and difficult to store when not in use.

It is therefore desirable to provide an improved rowing machine that addresses at least in part the above described problems and/or which more generally offers improvements or an alternative to existing arrangements.

SUMMARY

The present disclosure generally provides a stowable rowing machine or rower. The rower is extendable or collapsible depending on user preference. For example, the rower may be extended to a use configuration to permit a user to perform rowing type exercises. The rower may be collapsed to a storage configuration to reduce a footprint size of the rower and permit the rower to be stored in a relatively small space. In some embodiments, the rower may include an adjustment assembly operable to selectively engage and disengage portions of the rower such that the rower may be moved between positions. In some embodiments, the adjustment assembly may be infinitely adjustable to secure the portions of the rower in substantially any position relative each other.

Embodiments of the present disclosure may include a rowing machine. The rowing machine may include a frame, a seat rail selectively movable relative the frame between storage and use configurations, and an adjustment assembly movably coupling the seat rail to the frame and operable to releasably secure the seat rail to the frame. The adjustment assembly may include a plurality of securing elements configured to selectively engage the seat rail to secure the seat rail in position. The adjustment assembly may include a plurality of guide elements configured to selectively engage the seat rail, the plurality of guide elements including at least one disengagement guide element. When the seat rail is engaged with the at least one disengagement guide element, the seat rail is disengaged from the plurality of securing elements.

Embodiments of the present disclosure may include a rowing machine. The rowing machine may include a frame and a seat rail slidably coupled to the frame and selectively movable towards and away from the end plane between storage and use configurations. The frame may include first and second frame members each including an end portion, the end portions together defining an end plane. In the storage configuration, no portion of the seat rail may cross the end plane of the frame.

Embodiments of the present disclosure may include a rowing machine. The rowing machine may include a first frame member, a second frame member coupled to the first frame member, and a seat rail movably coupled to the first frame member and movable between storage and use configurations. The first and second frame members may define an area therebetween including a base extending between terminal end portions of the first and second frame members. At least a portion of the seat rail may extend within the area when in the storage configuration.

Embodiments of the present disclosure may include a method of assembling a rowing machine. The method may include coupling first and second frame members together to define a frame including an area between the first and second frame members, movably coupling a seat rail to the frame such that at least a portion of the seat rail extends within the area when in a storage configuration, and selectively engaging the seat rail to the frame via an engagement structure.

Additional embodiments and features are set forth in part in the description that follows, and will become apparent to those skilled in the art upon examination of the specification and drawings or may be learned by the practice of the disclosed subject matter. A further understanding of the nature and advantages of the present disclosure may be realized by reference to the remaining portions of the specification and the drawings, which forms a part of this disclosure.

One of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

FIGS. 1A-8 illustrate an exemplary embodiment of a stowable rowing machine or rower 100 including at least one adjustment assembly 102 operable to expand or collapse the rower 100 as desired. As detailed below, the adjustment assembly 102 may permit the rower 100 to selectively expand or collapse between use and storage positions, respectively. For example, as provided herein, the expandable nature of the rower 100 may allow a user to customize the size and/or function of the rower 100. In one embodiment, the rower 100 may be selectively expanded or collapsed to provide a varied length, a varying fitness characteristic, or the like, as more fully explained below. Additionally, a more collapsed version may allow the rower 100 to be stowed or stored in a relatively small area, such as by selectively reducing the footprint size of the rower 100. In one example, the rower 100 may be oriented to rest upright on an end to be stored in a vertically-oriented position. Additionally or alternatively, a more collapsed or compact version may allow for easier movement or transport of the rower 100. In some embodiments, the rower 100 may be expanded or collapsed to adjust the rower 100 to a particular body size (e.g., child vs. adult).

Figure 1A:
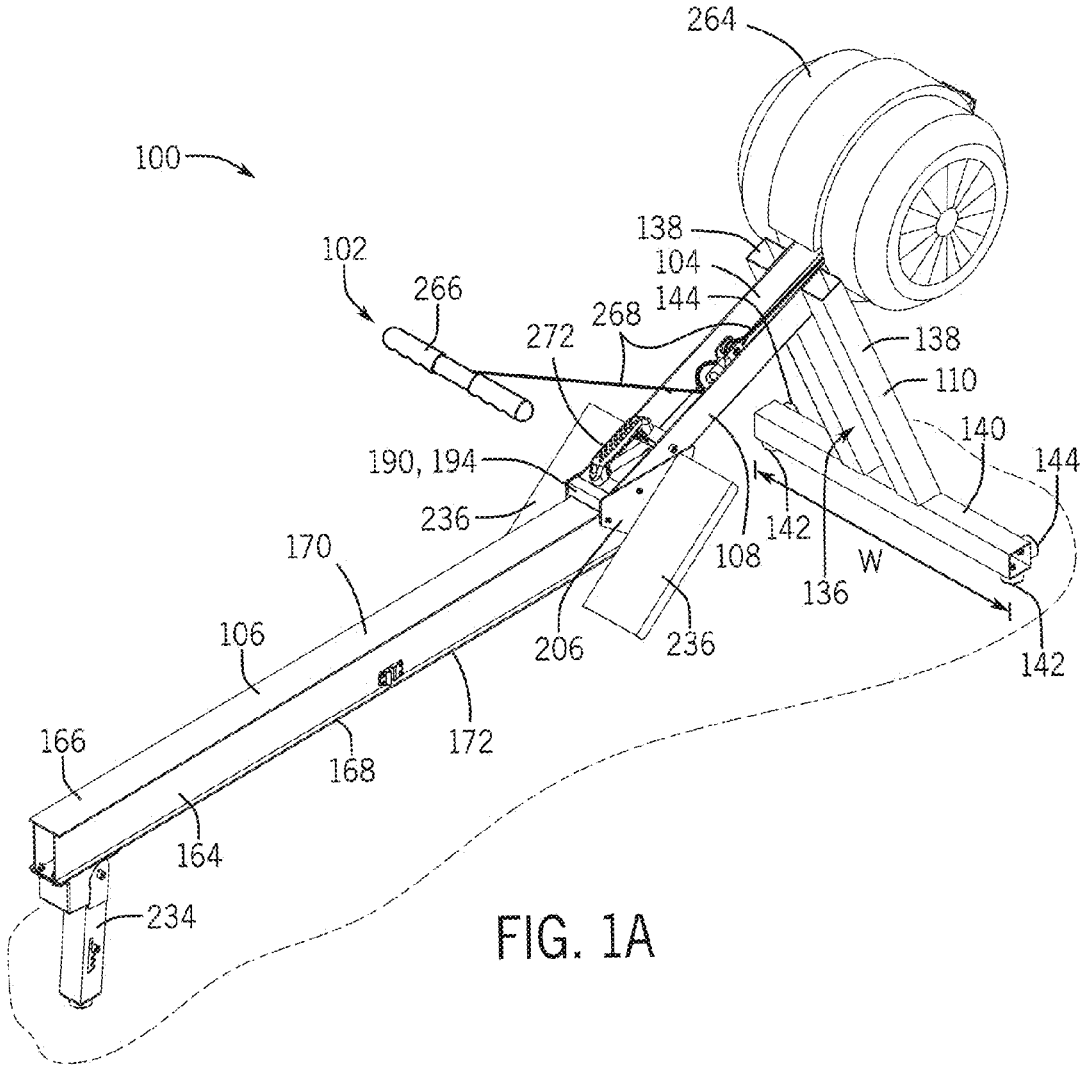
FIG. 1A is a top isometric view of a rower in an expanded, use configuration.
Figure 1B:
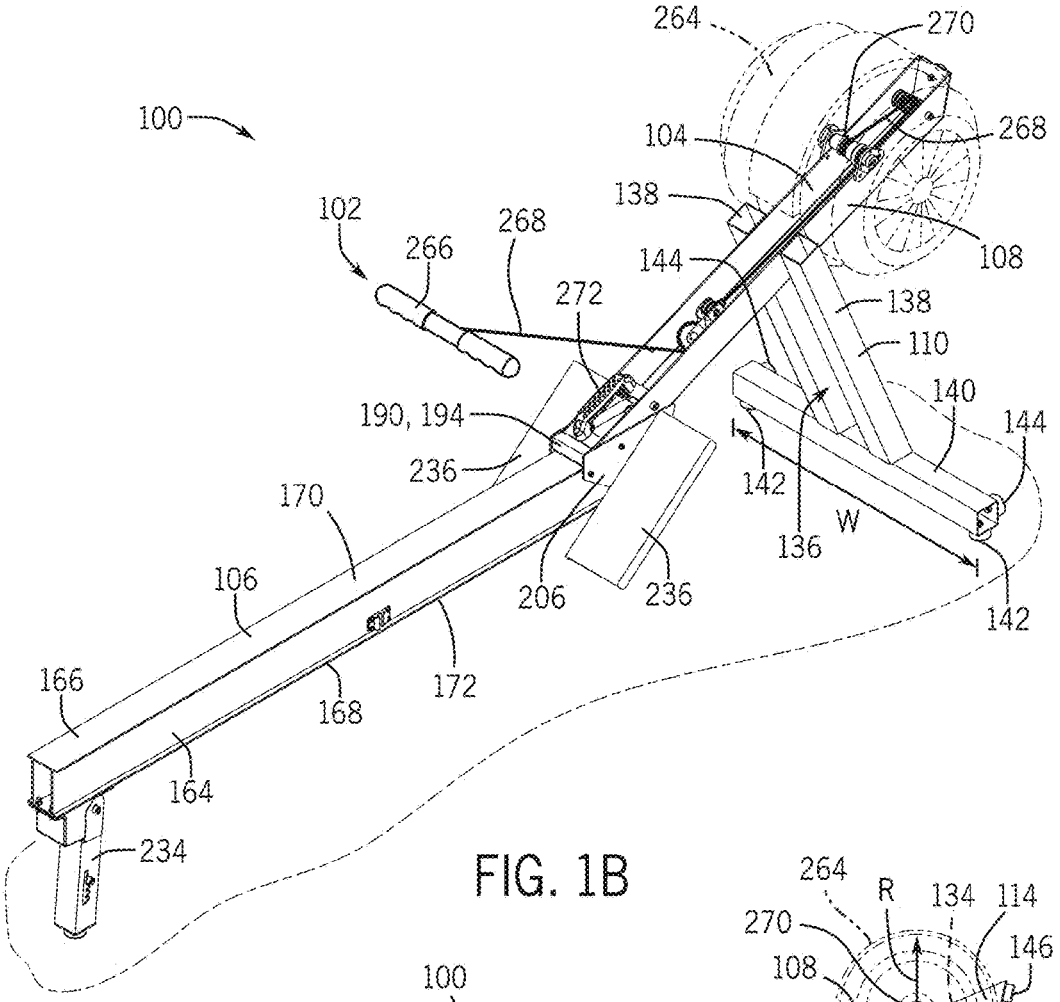
FIG. 1B is a top isometric view of the rower of FIG. 1A with a resistance engine dashed for illustration purposes.

Referring to FIGS. 1A and 1B, an embodiment of the rower 100 may include a frame 104 and an elongated seat rail 106 movably (e.g. slidably or rollably) coupled thereto. The seat rail 106 may be movable relative the frame 104 to expand or collapse the rower 100. For example, the seat rail 106 may move relative the frame 104 between use and storage configurations (see FIGS. 1A and 6, respectively), which may be discrete positions defined by the engagement between the seat rail 106 and the frame 104. Though FIGS. 1A-8 show the seat rail 106 moving between two positions, the rower 100 may be configured such that the seat rail 106 moves between any number of positions by, for example, providing an adjustment assembly 102 (see FIGS. 11-20 and their associated description below) allowing for may adjustable positions.

Figure 2:
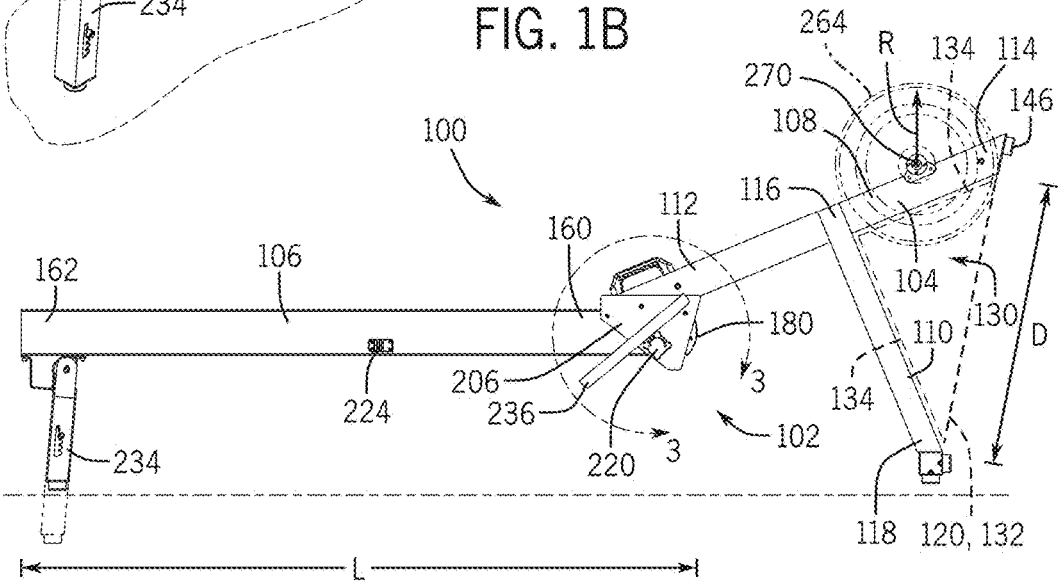
FIG. 2 is a side elevation view of the rower of FIG. 1B.

As shown in FIGS. 1A-2, the frame 104 may include a first frame member 108 and a second frame member 110. Each of the first and second frame members 108, 110 may include opposing first and second end portions 112, 114 and 116, 118, respectively. In one embodiment, the first end portion 116 of the second frame member 110 may be coupled to the first frame member 108, such as at a position between the first and second end portions 112, 114 of the first frame member 108 (e.g., about midway between the first and second end portions 112, 114 of the first frame member 108). The second frame member 110 may extend from the first frame member 108 at an angle to, for example, space the second end portions 114, 118 of the first and second frame members 108, 110 apart a distance D (see FIG. 2). The angle between the first and second frame members 108, 110 may be acute, obtuse, or substantially a right angle depending on the particular application. In such embodiments, the second end portions 114, 118, which may be referred to as terminal end portions, of the first and second frame members 108, 110 may together define an end plane 120 of the frame 104. As explained below, the seat rail 106 may be selectively movable towards and away from the end plane 120 between the storage and use configurations, respectively. However, portions of the rower 100, such as the seat rail 106, may, in some examples, not extend beyond or cross the end plane 120 when positioned in either the storage or use configuration. Though shown and described as not extending beyond or crossing the end lane 120, in some embodiments, the seat rail 106 may extend beyond the end plane 120 if storage is not desired or a priority.

Figure 7:
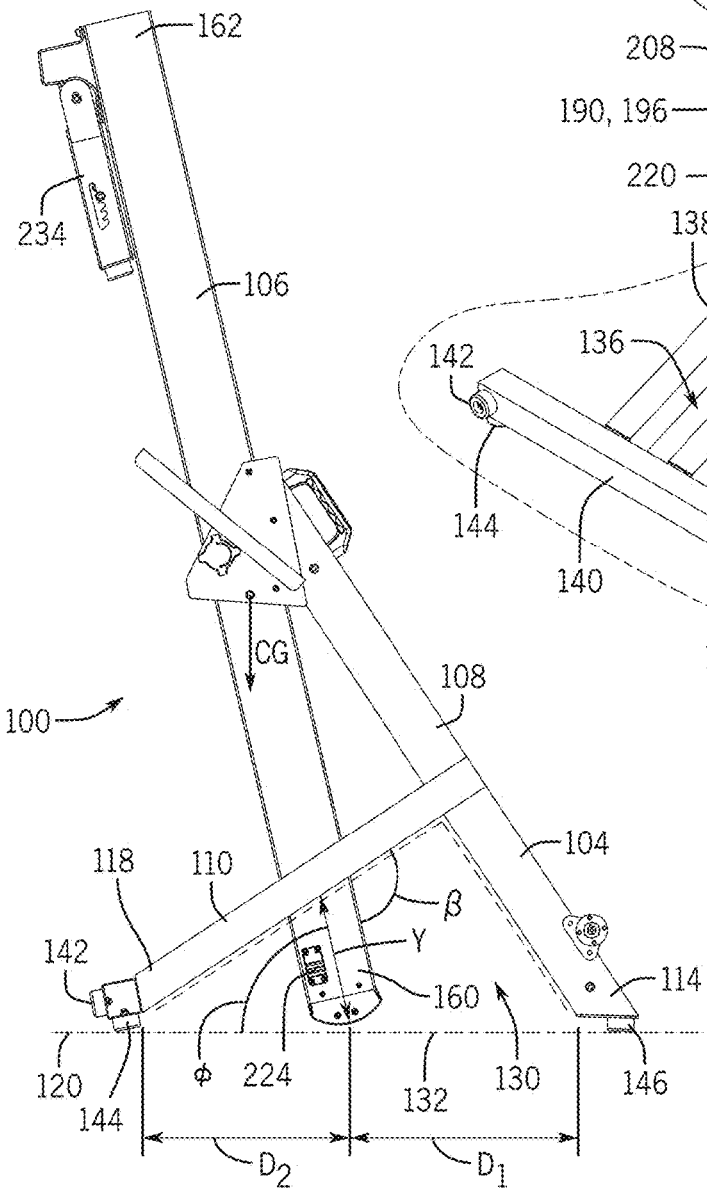
FIG. 7 is a side elevation view of the rower of FIG. 6.

With continued reference to FIG. 2, an area 130 may be defined between the first frame member 108, the second frame member 110, and at least a portion of the end plane 120. In such embodiments, the area 130 may include a base 132 extending between the second end portions 114, 118 of the first and second frame members 108, 110, such as congruent with the end plane 120. As shown, the area 130 may be triangular in shape, though other shapes are contemplated including polygonal or elliptic, among others. When triangular, the area 130 may include legs 134 extending along the first and second frame members 108, 110. As explained below, at least a portion of the seat rail 106 may extend within the area 130 when positioned in the storage configuration (see FIG. 7). In one example, as shown in FIG. 7, when in the storage configuration portions of seat rail 106 may not extend beyond the base 132 of the area 130 defined between the first and second frame members 108, 110.

Figure 6:
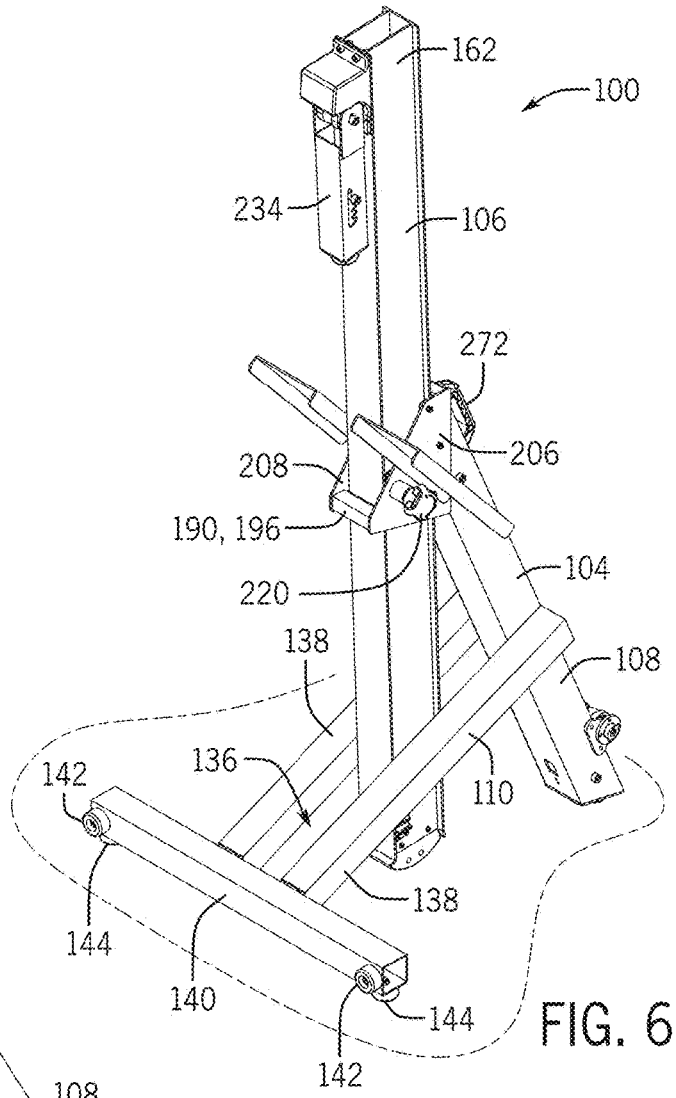
FIG. 6 is a top isometric view of a rower in a collapsed, storage configuration.

Turning to FIGS. 1B and 6, the second frame member 110 may be configured to permit the seat rail 106 to extend at least partially within the area 130. For example, the second frame member 110 may define an opening 136 therein. The seat rail 106 may extend at least partially through the opening 136 when moved to the storage configuration. As shown, the opening 136 in one embodiment is defined by a pair of struts 138 positioned on opposing sides of the first frame member 108, though other configurations are contemplated including an opening 136 defined within an integral body or a one-piece body of the second frame member 110 or the like, where a structure other than struts are used. The struts 138 may be attached to the first frame member 108 in substantially any manner, including without limitation fasteners, welding, or corresponding retention features, among others. In some embodiments, the first and second frame members 108, 110 may be formed or molded as a single element.

Continuing to refer to FIGS. 1B and 6, the frame 104 may be configured to support the rower 100 in either the storage or use configuration. For instance, a support bar 140 may be coupled to the second end portion 118 of the second frame member 110 for engagement with a support surface (e.g., the ground or floor). The support bar 140 may include a width W sufficient to laterally support the rower 100 and inhibit or limit tipping of the rower 100 to either side. As shown, a plurality of support pads may be coupled to the support bar 140 for engagement with the support surface. For example, the support bar 140 may include a first pair of support pads 142 operable to support the rower 100 in a use configuration. Additionally or alternatively, the support bar 140 may include a second pair of support pads 144 operable to support the rower 100 in the storage configuration. The first and second pairs of support pads 142, 144 may be positioned at an angle (e.g., substantially orthogonal) to each other to permit the rower 100 to be tilted on its end for storage (see FIG. 6), as detailed below. With reference to FIGS. 2 and 7, the second end portion 114 of the first frame member 108 may also include a support pad 146 coupled thereto for engagement with the support surface once the rower 100 is tilted on its end for storage. Each support pad 142, 144, 146 may be a rubber bumper or similar type support.

Figure 3:
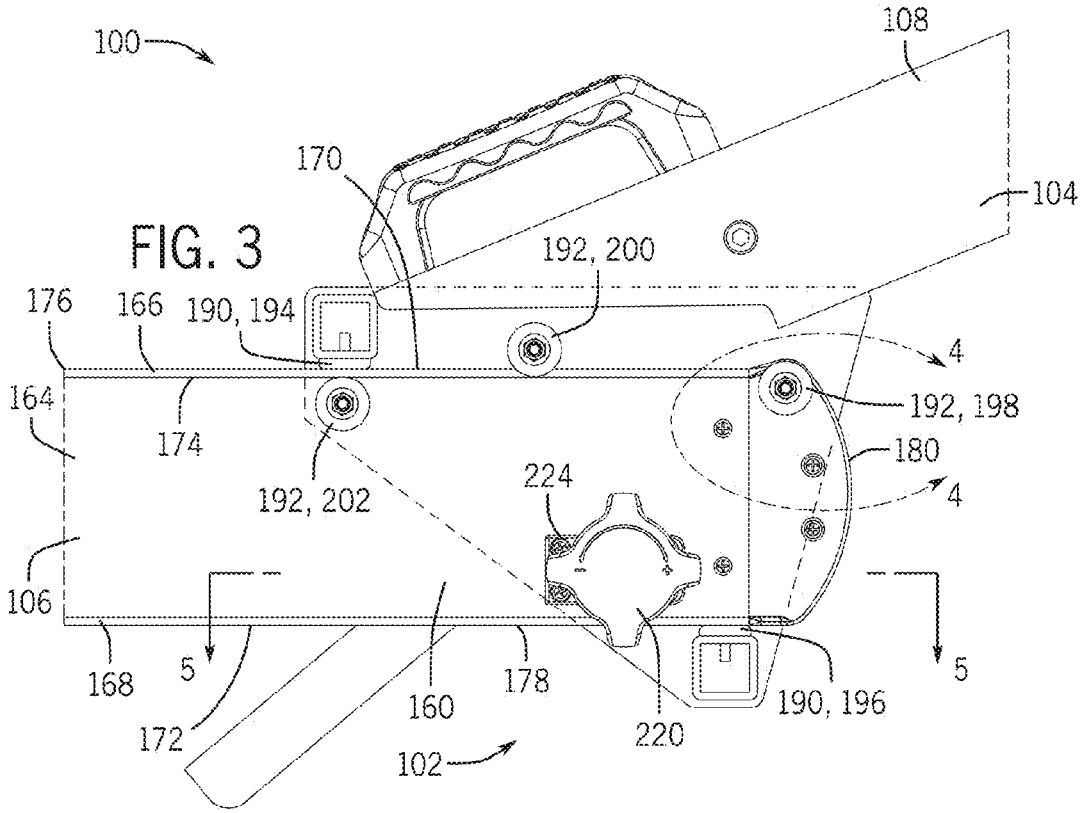
FIG. 3 is an enlarged side elevation view of the rower of FIG. 1A with a gusset plate and a foot support removed to illustrate an adjustment assembly.
Figure 10:
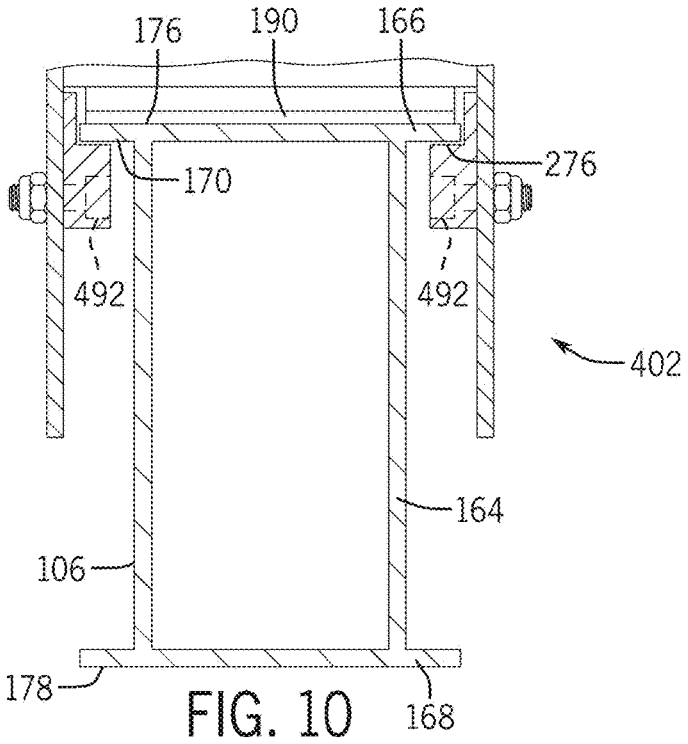
FIG. 10 is a cross-sectional view taken along section line 10-10 of FIG. 9.

With reference to FIG. 2, the seat rail 106 may be an elongate member having a length L defined between opposing first and second ends 160, 162. To provide a desired strength to weight ratio, the seat rail 106 may include an I-beam, a double I-beam, a rectangular tube or any other structural beam cross-section (see FIGS. 1A and 10, for instance). In one embodiment, the seat rail 106 may include a web 164 positioned between opposing first and second portions 166, 168, which may include first and second flanges 170, 172, respectively. Referring to FIGS. 3 and 10, the first flange 170, which may be an upper flange, may include opposing first and second surfaces 174, 176, which may be interior and exterior surfaces, respectively. Similarly, the second flange 172, which may be a lower flange, may include an exterior surface 178. As explained below, the first and second flanges 170, 172 may engage the adjustment assembly 102 to position the seat rail 106 relative the frame 104. For example, one portion of the adjustment assembly 102 may selectively engage a portion the seat rail 106 (e.g., the exterior surfaces 176, 178 of the first and second flanges 170, 172) to secure the seat rail 106 in position. Another portion of the adjustment assembly 102 may selectively engage another portion of the seat rail 106 (e.g., the first flange 170) to guide the seat rail 106 between configurations and/or disengage the portion of the adjustment assembly 102 engaged to the exterior surfaces 176, 178 of the first and second flanges 170, 172, as detailed more fully below. Though shown and described as including an I-beam structure, the seat rail 106 may include substantially any structure operable to engage the seat rail 106 to the frame 104. For example, the seat rail 106 may be a custom extrusion arranged to engage the adjustment assembly 102, such as including roller channels built into the sides of the seat rail 106 and straight or curved top and bottom surfaces that are engaged by similarly shaped surfaces of the frame 104.

Figure 4:
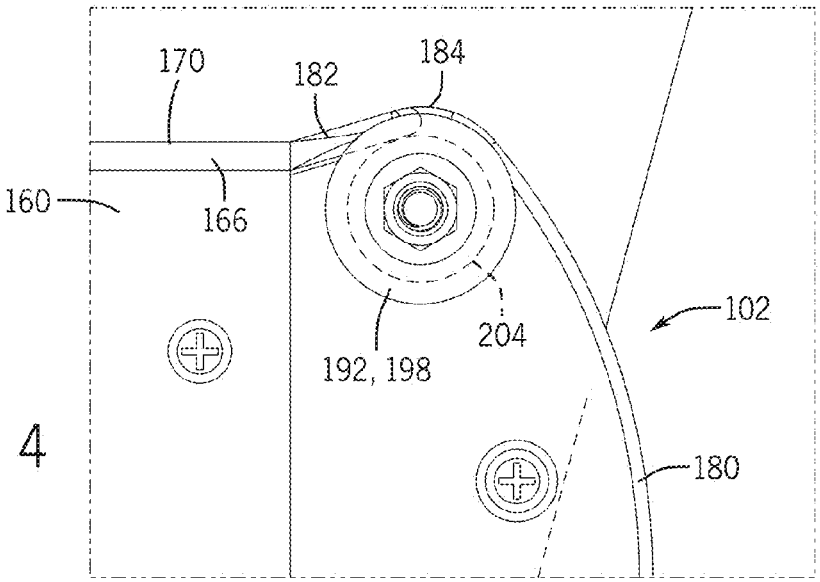
FIG. 4 is an enlarged view of a portion of the adjustment assembly of FIG. 3.

With reference to FIGS. 2 and 3, the first end 160 of the seat rail 106 may be coupled to the frame 104 (e.g., to the first frame member 108), such as via the adjustment assembly 102. The first and second ends 160, 162 of the seat rail 106 may be open (see second end 162 of seat rail 106 in FIG. 1A) or may be enclosed to provide a desired aesthetic and/or functional characteristic. For instance, as shown in FIGS. 2-4, the first end 160 of the seat rail 106 may include an end cap 180 configured to facilitate engagement and/or disengagement of the adjustment assembly 102 with or from the seat rail 106. For example, as best seen in FIG. 4, the end cap 180 may be sized and shaped to include a ramp 182 adjacent the first flange 170 of seat rail 106. As shown, the ramp 182 extends upwardly away from the first flange 170 to a bottom wall 184 to define a recess that allows the adjustment assembly 102 to engage the seat rail 106, as explained below. For example, the ramp 182 may allow the seat rail 106 to rotate out of engagement with a portion of the adjustment assembly 102 to permit the seat rail 106 to move relative the frame 104.

Figure 8:
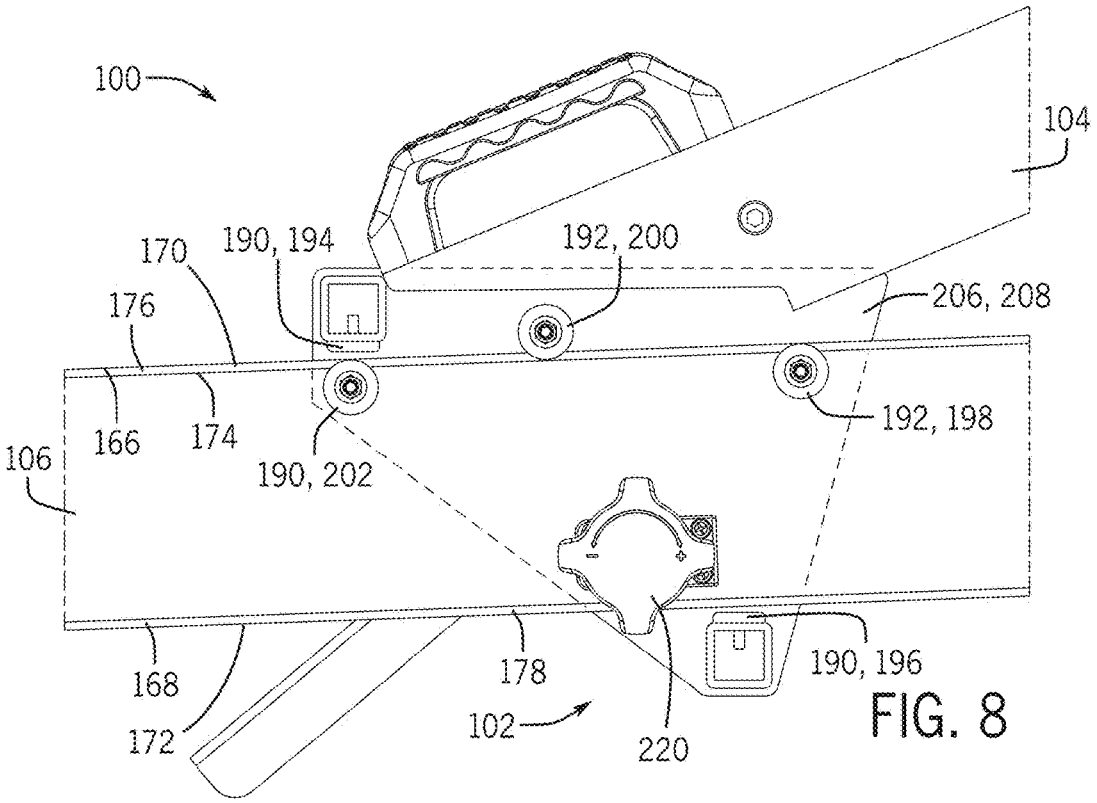
FIG. 8 is an enlarged side elevation view of the rower of FIG. 6 with a gusset plate and a foot support removed to illustrate an adjustment assembly.

Referring now to FIGS. 3 and 8, the adjustment assembly 102 may movably couple the seat rail 106 to the frame 104 and may be operable to releasably secure the seat rail 106 to the frame 104 in a desired position. In one embodiment, the adjustment assembly 102 may include a plurality of securing elements 190 and a plurality of guide elements 192. The securing elements 190 may be configured to selectively engage the seat rail 106 to secure the seat rail 106 in position. The guide elements 192 may be configured to selectively engage the seat rail 106 and to selectively disengage the seat rail 106 from the securing elements 190 (e.g., to permit the seat rail 106 to move relative the frame 104). In some embodiments, engagement of the guide elements 192 and/or engagement of securing elements 190 with the seat rail 106 may be dependent upon the position of the seat rail 106 relative the frame 104. For example, in a use configuration, at least one of the guide elements 192 (e.g., two or more of the guide elements 192) may be disengaged from the seat rail 106. In like manner, in a storage or transitory configuration, at least one of the securing elements 190 (e.g., two or more of the securing elements 190) may be disengaged from the seat rail 106 to permit the seat rail 106 to move relative the frame 104.

As shown in FIGS. 3 and 8, the securing elements 190 may be configured to selectively engage the seat rail 106, such as the first and second flanges 170, 172 of the seat rail 106. For instance, at least one securing element, such as a first securing element 194, may engage the top of the seat rail 106 (e.g., the first flange 170), and at least another securing element, such as a second securing element 196, may engage the bottom of the seat rail 106 (e.g., the second flange 172). As explained below, the first and second securing elements 194, 196 may be spaced apart laterally along the length L of the seat rail 106 to limit rotation of the seat relative the frame 104. For example, with reference to FIG. 3, the first and second securing elements 194, 196 may limit rotation of the seat rail 106 in a first direction (e.g., clockwise in FIG. 3), which may correspond to the direction in which the seat rail 106 is biased to rotate in use. As described herein, the first and second securing elements 194, 196 may frictionally or by interference fit engage the top and bottom of the seat rail 106 (e.g., first and second flanges 170, 172 of the seat rail 106, respectively) to limit movement of the seat rail 106 relative the frame 104 once engaged. For example without limitation, the first and second securing elements 194, 196 may be a friction pad operable to contact the exterior surfaces 176, 178 of the seat rail 106. Additionally or alternatively, the first and second securing elements 194, 196 may meshingly engage the exterior surfaces 176, 178 of the seat rail 106, such as via meshing undulating or gear-like surfaces, among others. In some embodiments, the first and second securing elements 194, 196 may extend across the width of the seat rail 106 (see FIGS. 1A and 6) to provide sufficient engagement between the seat rail 106 and the securing elements to effectively lock the seat rail 106 relative the frame 104 during use of the rower 100.

The plurality of guide elements 192, in this example, may include a first guide element 198, a second guide element 200, and a third guide element 202 positioned on each side of the seat rail 106. Except as otherwise noted, the description below discusses the guide elements 192 positioned on one side only (e.g., the right side of the rower 100 as viewed in FIG. 1A). The guide elements 192 positioned on the opposite side of the seat rail 106 may be configured substantially identically or only similarly. Each of the first, second, and third guide elements 198, 200, 202 may selectively engage the seat rail 106 to facilitate the seat rail 106 to move relative the frame 104. For example, the first and third guide elements 198, 202 may selectively engage the seat rail 106 below the first portion 166 (e.g., the first surface 174 of the first flange 170), and the second guide element 200 may selectively engage the seat rail 106 above the first portion 166 (e.g., the second surface 176 of the first flange 170). In this manner, at least a portion of the seat rail 106 (e.g., the first flange 170) may be positioned between the guide elements 192. Further, when the seat rail 106 is engaged with certain of the guide elements 192, which for convenience may be referred to as "disengagement guide elements," the seat rail 106 is disengaged from the securing elements 194, 196. For the embodiment of the device depicted in FIGS. 1A-8, the disengagement guide elements may include the second and third guide elements 200, 202. That is, when the seat rail 106 is engaged with the second and third guide elements 200, 202, the seat rail 106 is disengaged from the securing elements 194, 196. Any number of the guide elements 198, 200, 202 could be disengagement guide elements.

To rotatably support the seat rail 106 relative the frame 104, the second guide element 200 may be positioned laterally between the first and third guide elements 198, 202 along the length L of the seat rail 106. In the embodiments described herein, each of the guide elements 192 may include a bushing or roller 204 (see FIG. 4) such that the adjustment assembly 102 slidably or rollably couples the seat rail 106 to the frame 104. As explained below, at least one of the guide elements 192 (e.g., the first guide element 198) may be movable to disengage the seat rail 106 from the securing elements 190.

As described herein, the adjustment assembly 102 may be associated with the frame 104. For example, the adjustment assembly 102 may be coupled to the first end portion 112 of the first frame member 108. As shown, the adjustment assembly 102 may include a pair of gusset plates 206 positioned on opposite sides of the first frame member 108, such as via fasteners, welding, a unitary structure, or the like. In such embodiments, the guide elements 192 may be coupled to interior surfaces 208 of the gusset plates 206. Once assembled, at least a portion of the guide elements 192 on each side of the seat rail 106 may be positioned within the space defined between the web 164 and flanges of the seat rail 106 (see FIG. 10, for instance). As shown, the securing elements 190 may extend between the gusset plates 206, such as being connected to the interior surfaces 208 of the opposing gusset plates 206.

Figure 5:
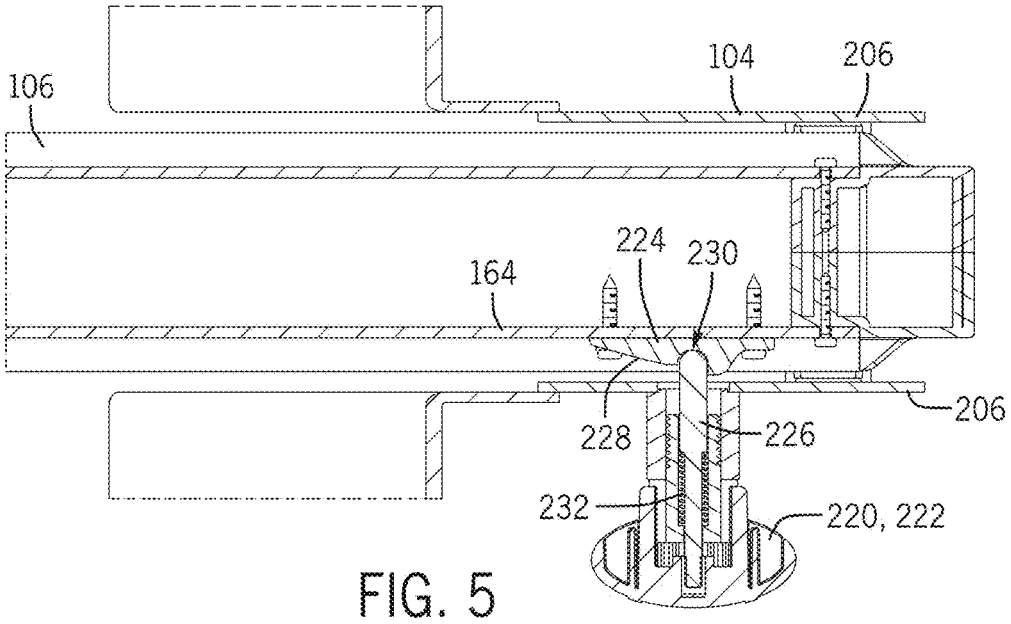
FIG. 5 is a cross-sectional view taken along section line 5-5 of FIG. 3 and showing a releasable lock structure.

Turning to FIGS. 1A-3 and 5, the rower 100 may include other features for convenience. For example, as shown in FIGS. 2, 3, and 5, the rower 100 may include a lock mechanism 220 operable to lock the seat rail 106 in a desired position. In one embodiment, the lock mechanism 220 includes a releasable latch structure 222. The latch structure 222 may include at least two catches 224 associated with the seat rail 106 and a securement mechanism 226 coupled to the frame 104 (e.g., to one of the gusset plates 206). The securement mechanism 226, which may be referred to as a pop pin, is selectively securable to the catches 224 to define discrete positions of the seat rail 106 relative the frame 104, such as the storage and use configurations discussed above. As shown in FIG. 5, each catch 224 includes a ramp 228 extending away from the web 164 of the seat rail 106 and terminating at an open cavity 230. During operation, the seat rail 106 may slide against or roll along the guide elements 192 until the securement mechanism 226 engages the ramp 228. Continued movement of the seat rail 106 may move the securement mechanism 226 away from the web 164 via the ramp 228 until the securement mechanism 226 is aligned with the cavity 230, at which point the securement mechanism 226 is seated within the cavity 230, such as automatically via a spring 232 biasing the securement mechanism 226 towards the seat rail 106. Once seated within the cavity 230, the securement mechanism 226 may limit further movement of the seat rail 106 either towards or away from the end plane 120. Though shown and described as engaging catches 224 attached to the seat rail 106, the securement mechanism 226 may engage other portions of the rower 100 to define the discrete positions of the seat rail 106. For example, the securement mechanism 226 may engage apertures defined within the web 164 of the seat rail 106 or the like.

Referring to FIGS. 1A-2, 6, and 7, the rower 100 may include a rear post 234 coupled to the seat rail 106 (e.g., to the second end 162 of the seat rail 106) to support the rower 100 on a support surface. For compactness, the rear post 234 may move between storage and use positions. For example, the rear post 234 may be rotatably coupled to the seat rail 106. In a storage position, the rear post 234 may extend substantially parallel to the seat rail 106 (see FIGS. 6 and 7). In a use position, the rear post 234 may rotate away from the seat rail 106 to a desired position to space the second end 162 of the seat rail 106 away from the support surface (see FIGS. 1A-2). In some embodiments, the rear post 234 may be extendable to alter the angle of the seat rail 106 relative the support surface (see dashed portion of rear post 234 in FIG. 2). For example, the rear post 234 may be extended to increase the angle of the seat rail 106 relative the support surface to provide an increased workout level or to account for an uneven support surface, for instance.

As shown in FIG. 1A, the rower 100 may include other features to permit operation of the rower 100. For instance, the rower 100 may include a pair of foot supports 236 coupled to a portion of the frame 104, such as to the gusset plates 206. During operation, a user may push off of the foot supports 236 to perform a desired rowing exercise. To limit undesirable user interference with the lock mechanism 220, the foot supports 236 may be positioned to shield and/or protect the lock mechanism 220 during use, such as being positioned above the lock mechanism 220 (see FIG. 2). In this manner, a user may not inadvertently release the lock mechanism 220 while performing rowing-type exercises. The foot supports 236 may be fixed to the gusset plate 206 or may be adjustable, such as being rotatably coupled to the gusset plates 206, depending on the particular application.

Figure 21:
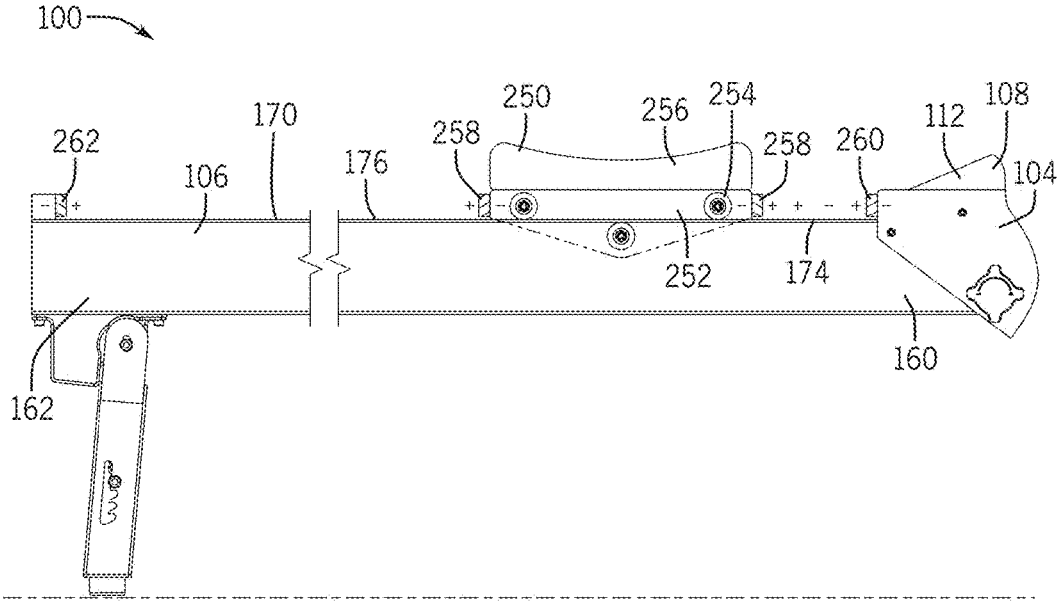
FIG. 21 is a fragmentary side elevation view of the rower of FIG. 1A showing a seat movably coupled to a seat rail.

With reference to FIG. 21, the rower 100 may include a seat 250 slidably coupled to the seat rail 106 (e.g., to the first flange 170 of the seat rail 106). As shown, the seat 250 includes a base 252, a plurality of rollers 254 coupled to the base 252, and a cushion 256. The rollers 254 may engage the first flange 170 of the seat rail 106 to permit sliding engagement of the seat 250 with the seat rail 106 but also limit axial movement of the seat 250 away from the seat rail 106. For instance, at least one roller 254 may be rollably coupled to the first surface 174 of the first flange 170 and at least another roller 254 may be rollably coupled to the second surface 176 of the first flange 170 such that a portion of the first flange 170 is positioned between the rollers 254. While performing rowing type exercises, a user may sit on the seat 250 (i.e., on the cushion 256) and slide along the seat rail 106 as the user pushes away from the foot supports 236. As shown, the seat 250 may slide along the seat rail 106 between adjacent the first and second ends 160, 162 of the seat rail 106. In some embodiments, the seat 250 may include zero-contact stopping points. For example, a pair of magnets 258 may be attached to opposing sides of the seat 250, with corresponding, but repelling, magnets 260, 262 attached to the frame 104 (e.g., to the first end portion 112 of the first frame member 108) and to the second end 162 of the seat rail 106, respectively. Together, the magnets 258 of the seat 250 and corresponding magnets 260, 262 of the seat rail 106 may provide a repelling magnet force on the seat 250. As the seat 250 slides to adjacent the frame 104, the repelling magnet force of the magnets 258, 260 may bias the seat 250 away from the frame 104 and towards the second end 162 of the seat rail 106. In like manner, as the seat 250 slides to adjacent the second end 162 of the seat rail 106, the repelling magnet force of the magnets 258, 262 may bias the seat 250 away from the second end 162 and towards the frame 104. In this manner, the repelling magnet force may limit the seat 250 from contacting the frame 104 or the second end 162 of the seat rail 106, thereby reducing noise and/or aiding in the functional exercise provided by the roller.

Turning back to FIG. 1A, to provide a rowing resistance, the rower 100 may include a resistance engine 264 coupled to the frame 104 (e.g., to the first frame member 108) and one or more bars 266 coupled to the resistance engine 264 via one or more cables 268. During operation, the user may pull on the one or more bars 266 while performing rowing type exercises to actuate the resistance engine 264. The resistance engine 264 may provide variable resistance via a rotating air-resistance based fan-like mechanism, a magnetism based eddy current mechanism, a friction based brake mechanism, or the like. As shown in FIG. 2, at least a portion of the resistance engine 264 (e.g., a flywheel, a clutch assembly, or the like) may rotate about an axle 270 coupled to the frame. In such embodiments, the one or more cables 268 may wrap about or unwrap from the axle 270 while the user performs rowing type exercises. The axle 270 may be biased to wrap the one or more cables 268 thereabout to, for example, facilitate the cyclic nature of rowing exercises. In some embodiments, one or more of the resistance mechanisms may be rapidly adjusted while the user is using the rower 100 to provide variable intensity interval training, for instance. In some embodiments, the one or more cables 268 may be routed through the first frame member 108. In such embodiments, the resistance engine 264 may be positioned adjacent the second end portion 114 of the first frame member 108, and the one or more cables 268 may be routed to position the one or more bars 266 adjacent the first end portion 112 of the first frame member 108. Referring to FIG. 2, like the seat rail 106, portions of the resistance engine 264 (e.g., a housing encasing at least portions of the resistance mechanism(s)) may not extend beyond or cross the end plane 120 to permit the rower 100 to be tilted on end and stored. For example, the resistance engine 264 may be sized and shaped such that its maximum radius R does not extend beyond or cross the end plane 120 (see FIG. 2). Though shown and described as not extending beyond or crossing the end plane 120, the resistance engine 264 may extend beyond the end plane 120 in some embodiments if, for example, tilting the rower 100 on end for storage is not desired or a priority.

As shown in FIG. 1A, the rower 100 may include a handle 272 attached to the frame 104, such as to a top side of the first frame member 108. The handle 272 may be used to carry the rower 100 or to reposition and/or reconfigure the rower 100 as desired. For instance, a user may lift the rower 100 from the handle 272 to reposition the seat rail 106 between configurations. Additionally or alternatively, a user may tilt the rower 100 between use and storage positions (see FIGS. 1A and 6, respectively) via the handle 272.

Operation of the rower 100 will now be discussed in more detail with reference to FIGS. 2-5, 7, and 8. Turning initially to FIG. 8, to permit the seat rail 106 to slide relative the frame 104, the guide elements 192 may rollably engage the first flange 170 of the seat rail 106 to disengage the securing elements 190 from the seat rail 106, such as by angling the seat rail 106 relative the frame 104 to space the seat rail 106 away from the securing elements 190. For example, the first, second, and third guide elements 198, 200, 202 may be positioned such that the seat rail 106 is rotated (e.g., counterclockwise in FIG. 8) away from the first and second securing elements 194, 196 once the first, second, and third guide elements 198, 200, 202 engage the first flange 170. In the alignment shown in FIG. 8, the seat rail 106 may be free to slide relative the frame 104 to many desired positions to extend or collapse the rower 100. For example, the second end 162 of the seat rail 106 may be slid away from the frame 104 to extend the rower 100 to a desired size depending on the size of the user and/or the space constraints in which the rower 100 is positioned, for instance. Similarly, the second end 162 of the seat rail 106 may be slid towards the frame 104 to collapse the rower 100, such as to position the rower 100 in its storage orientation (see FIG. 7, for instance). As shown in FIG. 8, the lock mechanism 220 may be engaged to lock the seat rail 106 in discrete positions (e.g., in the storage configuration, in the use configuration, or the like). Once the lock mechanism 220 is disengaged, the seat rail 106 may be free to slide relative the frame 104 in the same manner discussed above.

Referring to FIGS. 3 and 4, once the seat rail 106 is positioned in the use configuration, the guide elements 192 may position the seat rail 106 into engagement with the securing elements 190. For instance, as the seat rail 106 is slid towards the use configuration, the first guide element 198 may traverse down the ramp 182 towards the bottom wall 184 of the end cap 180 to rotate the seat rail 106 towards the first and second securing elements 194, 196 (e.g., clockwise in FIG. 3). As explained herein, without the recess or clearance provided by the ramp 182, the guide elements 192 may stay engaged to the first flange 170 and limit or inhibit engagement of the securing elements 190 with the seat rail 106. Once the first guide element 198 engages the ramp 182, the seat rail 106 may rotate into engagement with the first and second securing elements 194, 196. When the seat rail 106 is sufficiently rotated, the first securing element 194 engages the top (e.g., the first flange 170) of the seat rail 106, and the second securing element 196 engages the bottom (e.g., the second flange 172) of the seat rail 106 as discussed above. Once engaged, the securing elements 190 secure the seat rail 106 in position by limiting sliding movement of the seat rail 106 relative the frame 104. When the seat rail 106 is positioned for use, at least two of the guide elements 192 (e.g., the second and third guide elements 200, 202, each of the first, second, and third guide elements 198, 200, 202, etc.) are disengaged from the seat rail 106. In the configuration shown in at least FIG. 3, during operation of the rower 100 by a user, the weight of the user may further bias the seat rail 106 into engagement with the securing elements 190 (e.g., further biasing the seat rail 106 to rotate towards the securing elements 190), thus strengthening the engagement between the seat rail 106 and the securing elements 190. As shown in FIG. 3, the lock mechanism 220 may be engaged to further secure the seat rail 106 in the use configuration.

Collapsing the rower 100 may be accomplished in substantially reverse order from that described above. To collapse the rower 100, a user may first disengage the lock mechanism 220. For instance, the securement mechanism 226 may be disengaged from the catch 224 to permit sufficient removal of the securement mechanism 226 from the cavity 230 defined in the catch 224. The user may then slide the seat rail 106 relative the frame 104, such as moving the first end 160 of the seat rail 106 towards the end plane 120. Once the seat rail 106 begins to slide from the use configuration, the first guide element 198 may traverse up the ramp 182 defined in the end cap 180, which causes the seat rail 106 to rotate (e.g., counterclockwise in FIG. 3) out of engagement with the securing elements 190. Once the seat rail 106 disengages the securing elements 190, the seat rail 106 is free to slide relative the frame 104. For example, the first end 160 of the seat rail 106 may slide towards the end plane 120, such as through the opening 136, until, for example, the securement mechanism 226 engages the catch 224 defining the storage configuration.

Once collapsed, the rower 100 may be tilted on end to store the rower 100 in a reduced footprint state. For example, the rower 100 may be tilted until the support pad 146 of the first frame member 108 and the second pair of support pads 144 of the second frame member 110 contact the support surface. Once tilted, the rear post 234 may be rotated towards the seat rail 106 to further reduce the footprint size of the rower 100 when stored. With reference to FIG. 7, the rower 100 may be configured for stability once collapsed and tilted on end. For instance, the size and shape of the rower 100 once collapsed may define a center of gravity CG of the rower 100 positioned between the second end portions 114, 118 of the first and second frame members 108, 110. As shown, the center of gravity CG may be positioned within the lateral extents of the base 132 of the area 130 when the seat rail 106 is positioned in the storage configuration and the rower is tilted on its end to engage the support pad 146 and the second pair of support pads 144 with a support surface. Such a configuration may limit tipping of the rower 100 fore and aft.

With continued reference to FIG. 7, the frame 104 and seat rail 106 may be arranged to achieve a desired characteristic when positioned for storage. For example, various amounts or portions of the seat rail 106 may be positioned within the area 130 depending on the size and arrangement of the frame 104. For instance, a sub-length Y of the seat rail 106 may be positioned within the area 130 when the rower 100 is collapsed. The sub-length Y in some embodiments may vary between about 5% and about 35% (preferably about 13%) of the total length L of the seat rail 106.

In some embodiments, the first end 160 of the seat rail 106 may be positioned a first distance $D_1$ away from the second end portion 114 of the first frame member 108, and a second distance $D_2$ away from the second end portion 118 of the second frame member 110 when the rower 100 is collapsed. As shown, the first distance $D_1$ may be greater than the second distance $D_2$ such that the first end 160 of the seat rail 106 is positioned nearer the second frame member 110 than the first frame member 108 when the rower 100 is collapsed. The ratio between the first and second distances $D_1$, $D_2$ (i.e., $D_1$:$D_2$) may vary between about 1:1 to about 1.5:1 (preferably about 1.1:1).

As shown in FIG. 7, the seat rail 106 may extend at an angle $\varphi$ relative the base 132. The angle $\varphi$ may vary between about 45 degrees and about 90 degrees (preferably about 77 degrees). In such embodiments, the seat rail 106 may be sized and shaped such that its second end 162 does not extend outside the lateral extents of the base 132 for at least stability purposes when the rower 100 is tilted and positioned on end. With continued reference to FIG. 7, the seat rail 106 may extend at an angle $\beta$ relative the second frame member 110. Depending on the particular application, the angle $\beta$ may vary between about 70 degrees and about 135 degrees (preferably about 110 degrees).

FIGS. 9-20 illustrate additional embodiments of an adjustment assembly 402, 702, 1002, 1302, 1602. With the exception of the description below, the adjustment assemblies 402, 702, 1002, 1302, 1602 of FIGS. 9-20 are similar to the adjustment assembly 102 and its associated description above. Accordingly, in certain instances, descriptions of like features will not be discussed when they would be apparent to those with skill in the art in light of the description above and in view of FIGS. 1A-20. For ease of reference, like structure is represented with appropriately incremented reference numbers.

Figure 9:
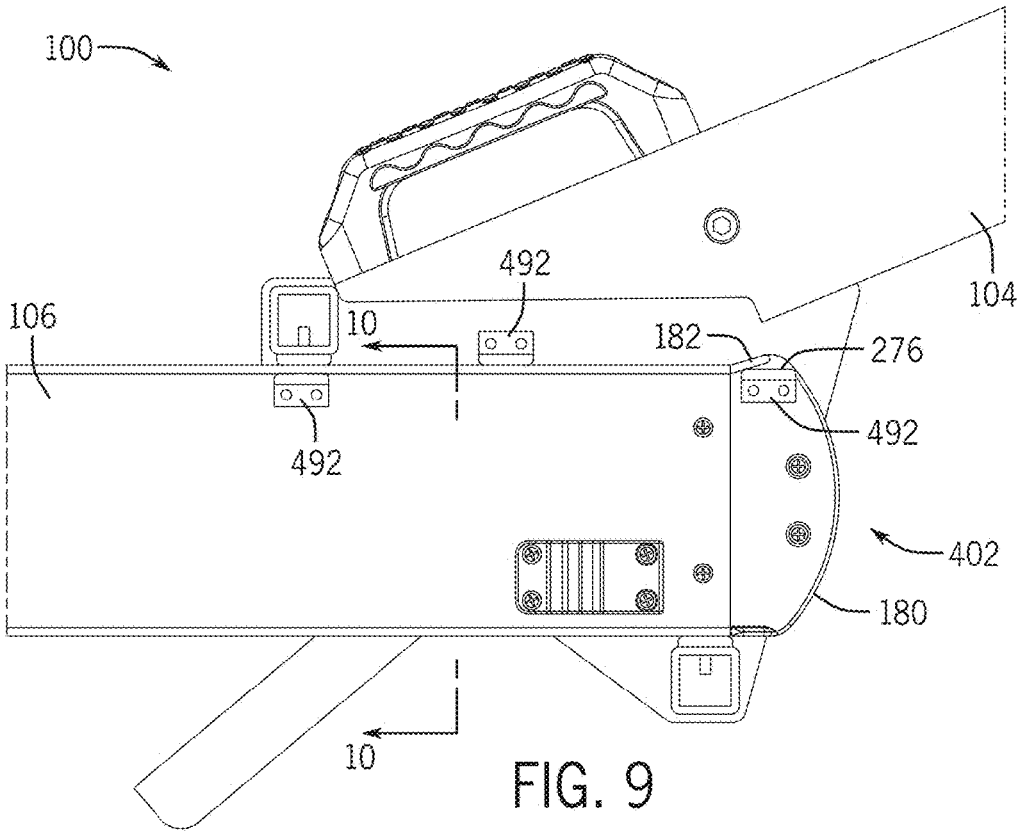
FIG. 9 is an additional side elevation view of the rower of FIG. 1A with a gusset plate and a foot support removed to illustrate an additional adjustment assembly.

Referring to FIGS. 9 and 10, the guide elements 492 in some embodiments may take the form of linear bushings. In such embodiments, rather than rolling against the first flange 170 of the seat rail 106, the seat rail 106 may slide against a support surface 276 of the bushings 492. The bushings 492 (i.e., at least the support surfaces 276 of the bushings 492) may be formed from or coated with material(s) having a low coefficient of friction, such as Teflon®, Delrin®, or the like.

Turning to FIGS. 11-20, the adjustment assembly 702, 1002, 1302, 1602 may be infinitely adjustable to lock the seat rail 106 in substantially any position between a fully extended and a fully collapsed position. For instance, at least one guide element 792, 1092, 1392, 1692 (e.g., the first guide element 798, 1098, 1398, 1698) may include a torsion spring configuration (see FIGS. 11-13), a torsion bar configuration (see FIGS. 14 and 15), a compression spring configuration (see FIGS. 16-18), and/or a tension spring configuration (see FIGS. 19 and 20). In each of these configurations, the first guide element 798, 1098, 1398, 1698 is biased to apply an upward force to the seat rail 106 to selectively cause the seat rail 106 to disengage from the securing elements 190. For example, when the user is seated on the rower 100, the user's weight will move the first guide element 798, 1098, 1398, 1698 downwards to allow the seat rail 106 to contact the securing elements 190. When the user is no longer seated on the rower 100, the first guide element 798, 1098, 1398, 1698 will rotate the seat rail 106 out of engagement with the securing elements 190, as explained more fully below. In this manner, the seat rail 106 may be slid to substantially any position relative the frame 104, at which point the user may sit on the rower 100 to cause the seat rail 106 to contact the securing elements 190.

Figure 11:
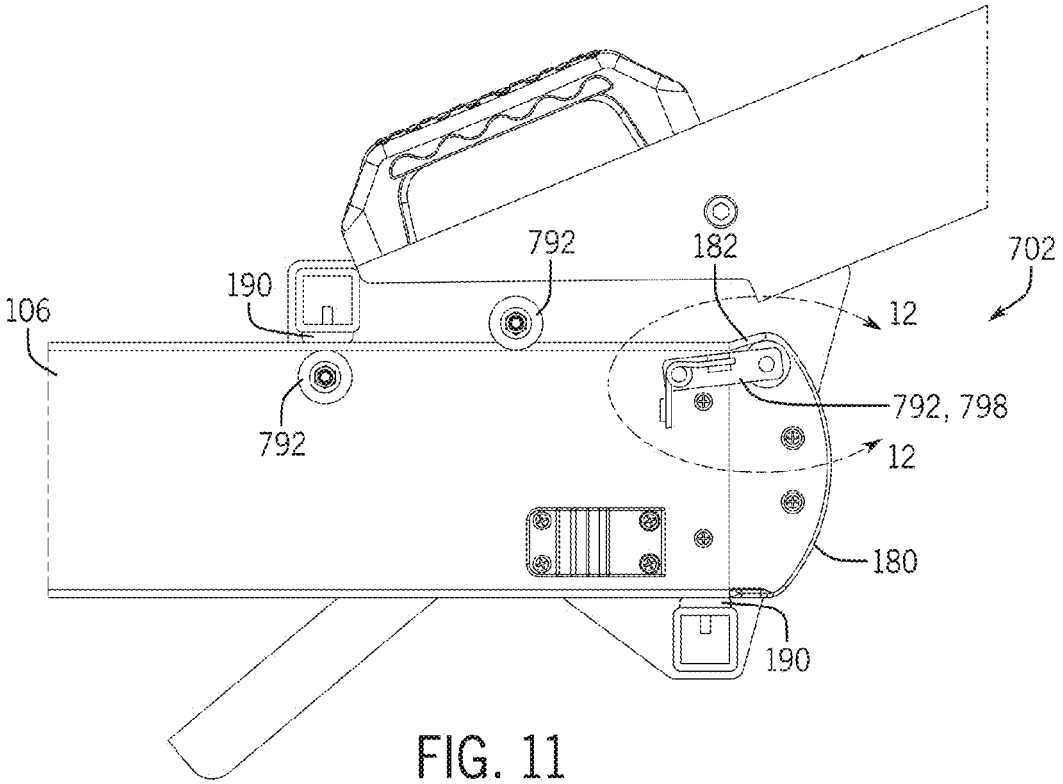
FIG. 11 is an additional side elevation view of the rower of FIG. 1A with a gusset plate and a foot support removed to illustrate an additional adjustment assembly.
Figure 12:
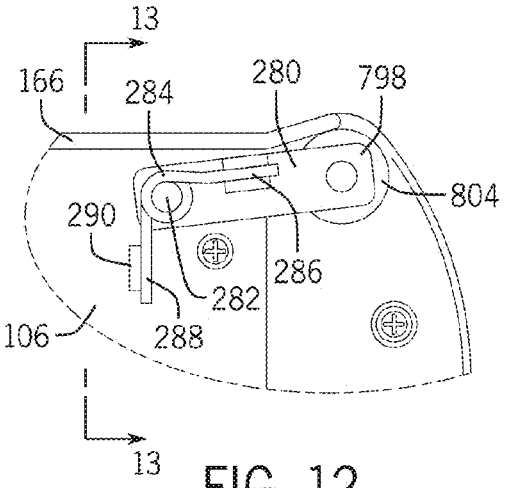
FIG. 12 is an enlarged view of a portion of the adjustment assembly of FIG. 11.
Figure 13:
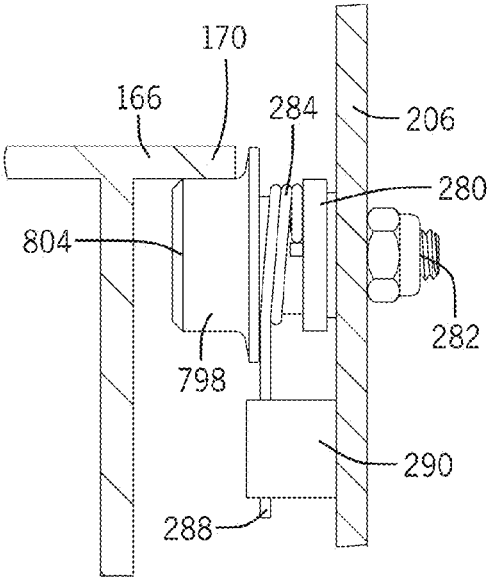
FIG. 13 is a fragmentary cross-sectional view taken along section line 13-13 of FIG. 12.

Referring to FIGS. 11-13, the first guide element 798 may include an arm 280 pivotably attached to the gusset plate 206 (e.g., via a pivot pin 282) and a torsion spring 284 including opposing first and second ends 286, 288. As shown in FIG. 12, the first end 286 of the torsion spring 284 may be coupled to the arm 280, and the second end 288 of the torsion spring 284 may be coupled to a bracket 290 extending from the gusset plate 206 (see FIG. 13). The torsion spring 284 may bias the arm 280 of the first guide element 798 to rotate about the pivot pin 282 in a first direction (e.g., counterclockwise in FIG. 12) to bias the roller 804 upwardly. In such embodiments, the rotating bias of the first guide element 798 may apply an upward force to the first flange 170 of the seat rail 106 via the roller 804, which causes the seat rail 106 to rotate out of engagement with the securing elements 190 under certain conditions. For example, the torsion spring 284 may be sized and shaped to maintain the seat rail 106 out of engagement with the securing elements 190 when the user is not seated on the rower 100. When the user is seated on the rower 100, the user's weight may overcome the bias provided by the torsion spring 284 and move the roller 804 of the first guide element 798 downwards, thus rotating the seat rail 106 into engagement with the securing elements 190 as explained above.

Figure 14:
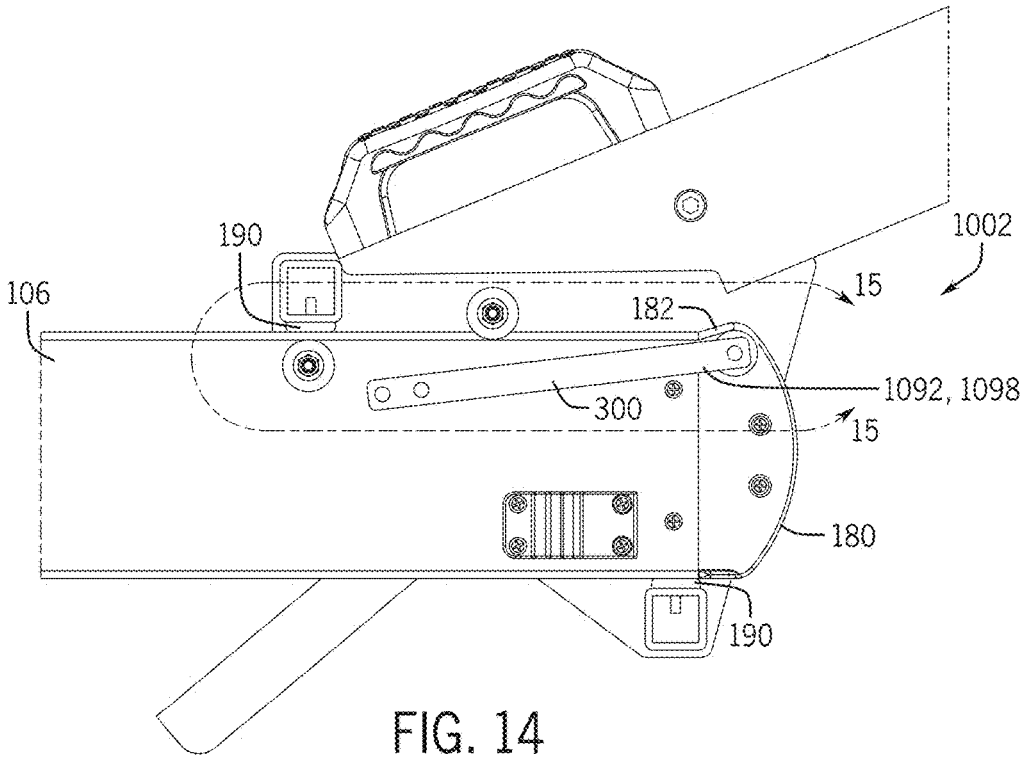
FIG. 14 is an additional side elevation view of the rower of FIG. 1A with a gusset plate and a foot support removed to illustrate an additional adjustment assembly.
Figure 15:
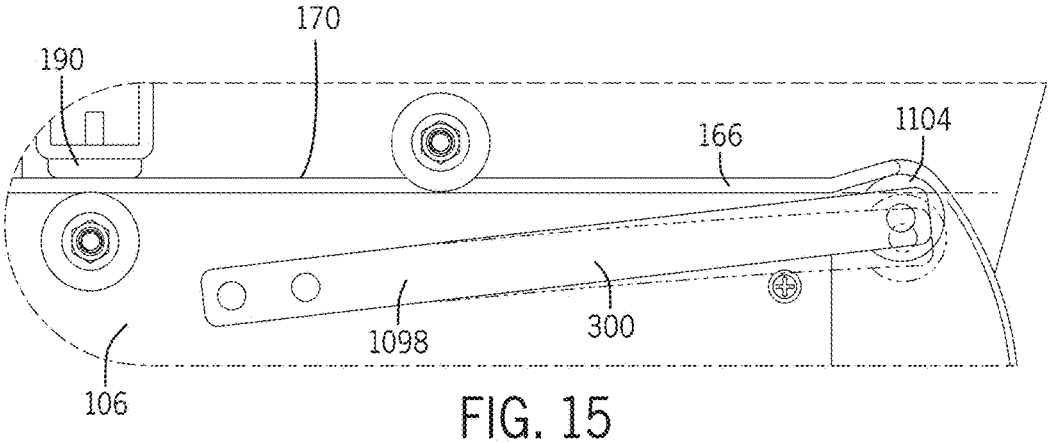
FIG. 15 is an enlarged view of a portion of the adjustment assembly of FIG. 14.

Turning to FIGS. 14 and 15, the first guide element 1098 may include a resilient bar 300 connected to the interior surface 208 of the gusset plate 206. Like the torsion spring 284 discussed above, the bar 300 may bias the roller 1104 of the first guide element 1098 to apply an upward force to the first flange 170 of the seat rail 106. For instance, the bar 300 may be sized and shaped to maintain the seat rail 106 out of engagement with the securing elements 190 when the user is not seated on the rower 100. When the user is seated on the rower 100, the user's weight may resiliently bend or flex the bar 300 and move the roller 1104 downwards (see dashed portion in FIG. 15), thus rotating the seat rail 106 into engagement with the securing elements 190.

Figure 16:
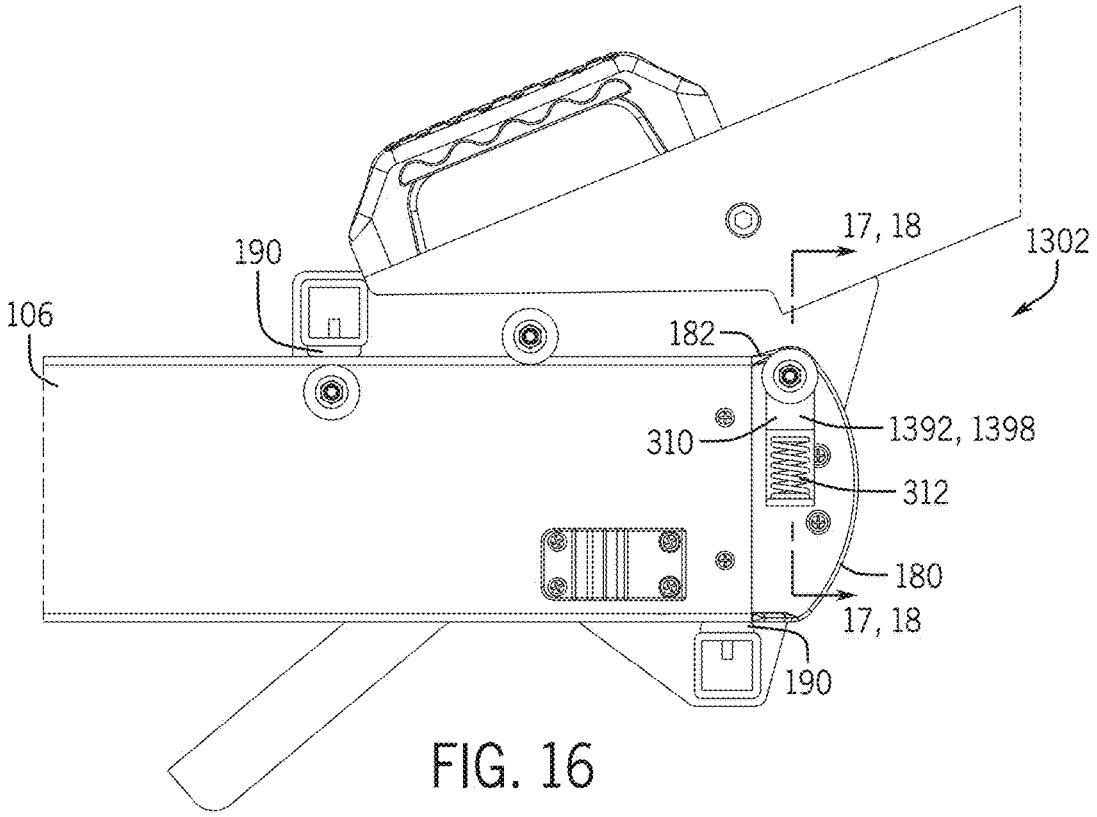
FIG. 16 is an additional side elevation view of the rower of FIG. 1A with a gusset plate and a foot support removed to illustrate an additional adjustment assembly.
Figure 17:
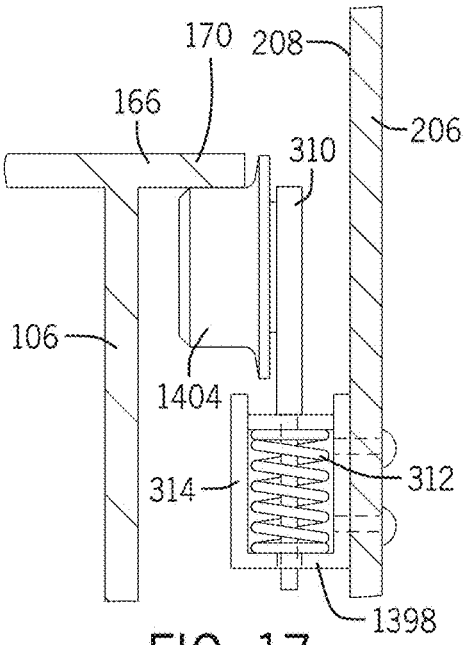
FIG. 17 is a fragmentary cross-sectional view taken along section line 17-17 of FIG. 16.
Figure 18:
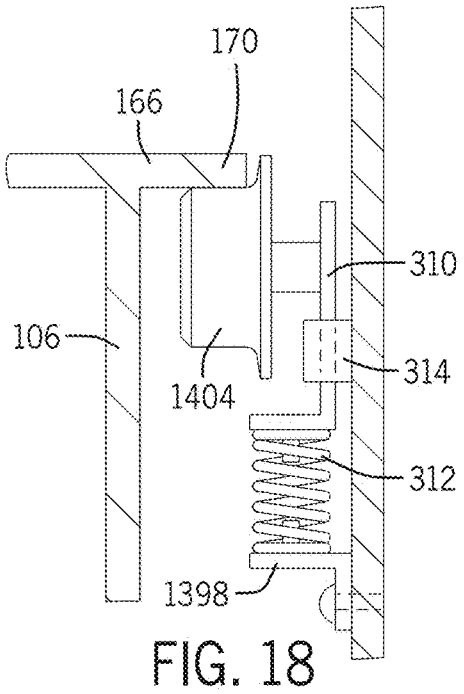
FIG. 18 is an additional fragmentary cross-sectional view taken along section line 18-18 of FIG. 16.

Referring now to FIGS. 16-18, the first guide element 1398 may include a bracket 310 slidably coupled to the interior surface 208 of the gusset plate 206 and a compression spring 312 connected to the bracket 310 and arranged vertically below the bracket 310. As shown in FIGS. 17 and 18, the bracket 310 may slide at least partially within a guide 314 connected to the interior surface 208 of the gusset plate 206. In some embodiments, the compression spring 312 may be positioned at least partially within the guide 314 (see FIG. 17). Like the embodiments described above, the compression spring 312 may bias the roller 1404 to apply an upward force to the first flange 170 of the seat rail 106. For example, the compression spring 312 may be sized and shaped to maintain the seat rail 106 out of engagement with the securing elements 190 when the user is not seated on the rower 100. When the user is seated on the rower 100, the user's weight may compress the compression spring 312 and move the roller 1404 of the first guide element 1398 downwards, thus rotating the seat rail 106 into engagement with the securing elements 190.

Figure 19:
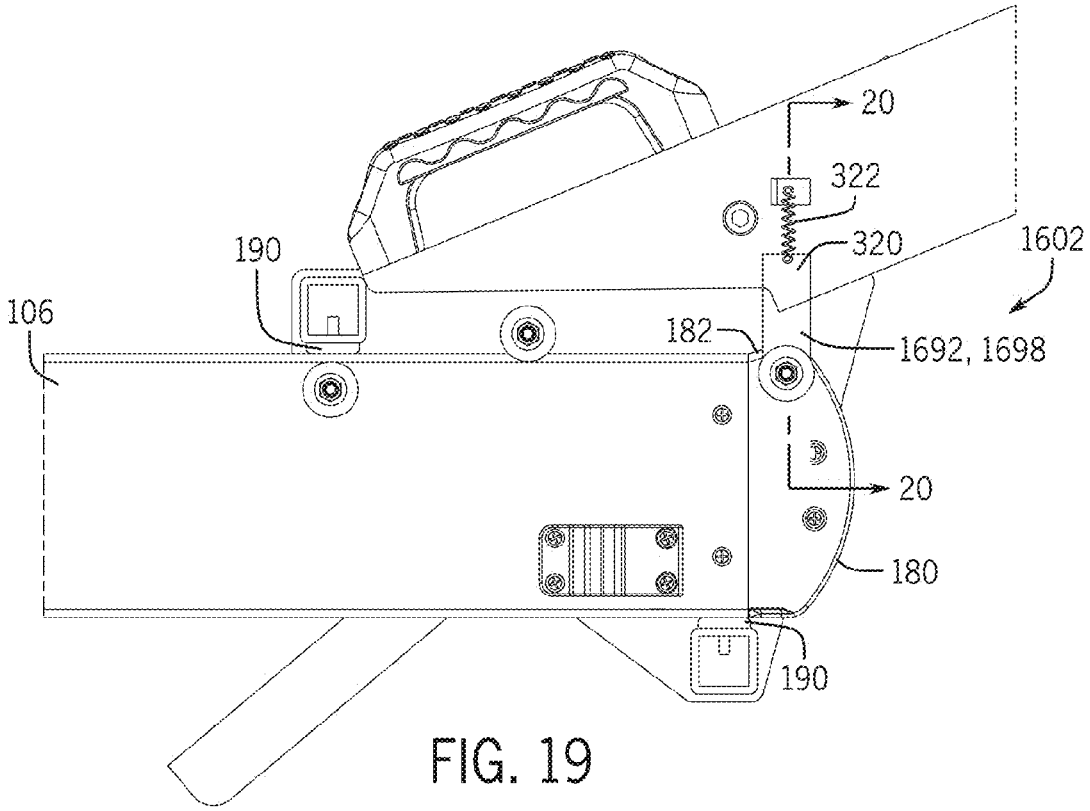
FIG. 19 is an additional side elevation view of the rower of FIG. 1A with a gusset plate and a foot support removed to illustrate an additional adjustment assembly.
Figure 20:
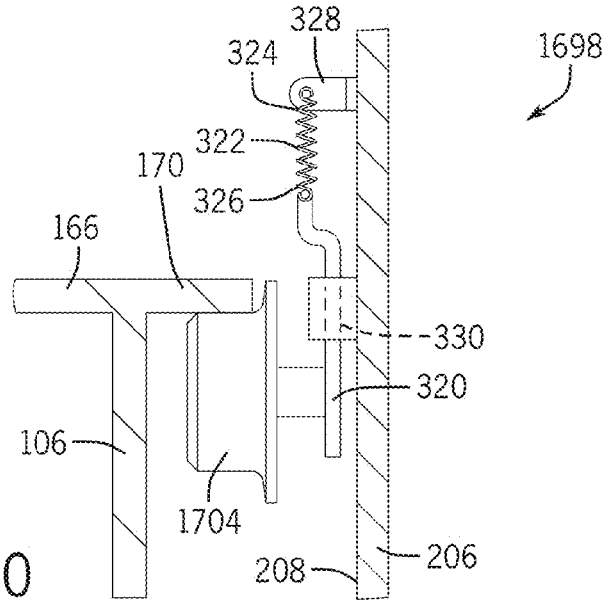
FIG. 20 is a fragmentary cross-sectional view taken along section line 20-20 of FIG. 19.

With reference to FIGS. 19 and 20, the first guide element 1698 may include a bracket 320 slidably coupled to the interior surface 208 of the gusset plate 206 and a tension spring 322 connected to the bracket 320 and arranged vertically above the bracket 320. As shown, the tension spring 322 may include opposing first and second ends 324, 326, the first end 324 connected to a post 328 extending from the interior surface 208 of the gusset plate 206, and the second end 326 connected to the bracket 320. In some embodiments, the bracket 320 may slide within one or more guides 330 connected to the interior surface 208 of the gusset plate 206. The tension spring 322 may bias the roller 1704 to apply an upward force to the first flange 170 of the seat rail 106. For example, the tension spring 322 may be sized and shaped to maintain the seat rail 106 out of engagement with the securing elements 190 when the user is not seated on the rower 100. When the user is seated on the rower 100, the user's weight may extend the tension spring 322 and move the roller 1704 downwards, thus rotating the seat rail 106 into engagement with the securing elements 190. The above embodiments are presented as non-limiting examples of an infinitely adjustable adjustment assembly. Though FIGS. 11-20 illustrate an infinitely adjustable adjustment assembly 702, 1002, 1302, 1602, the roller 804, 1104, 1404, 1704 in each of FIGS. 11-20 may also be associated with the ramp 182 defined in the end cap 180 to permit the seat rail 106 to engage the securing elements 190 in the same manner discussed above with reference to FIGS. 1A-8.

The rower 100 may be formed from a variety of materials and means. For instance, the frame 104, the seat rail 106, and each component of the adjustment assembly, among others, may be formed from metal, plastic, or any other suitable material with sufficient strength. In some embodiments, the seat rail 106 and the first and second frame members 108, 110 may be extruded from metal or another thermoformable material. Metals may include aluminum, steel, titanium, or any other suitable metal, alloy, or composite. Plastics may include a thermoplastic material (self-reinforced or fiber reinforced), nylon, LDPE, ABS, polycarbonate, polypropylene, polystyrene, PVC, polyamide, and/or PTFE, among others, and may be formed or molded in any suitable manner, such as by plug molding, blow molding, injection molding, extrusion, or the like. In some embodiments, at least some of the components of the rower 100 (e.g., the foot supports 236, the frame 104, and the rear post 234, among others) may be coated with a vinyl, a rubberized material, or any other coating for increased durability.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A rowing machine, comprising:

a frame;

a seat rail selectively movable relative to the frame between storage and use configurations; and an adjustment assembly movably coupling the seat rail to the frame and operable to releasably secure the seat rail to the frame, the adjustment assembly comprising:

a plurality of securing elements configured to selectively engage the seat rail to secure the seat rail in position; and a plurality of guide elements configured to selectively engage the seat rail, the plurality of guide elements including at least one disengagement guide element, wherein when the seat rail is engaged with the at least one disengagement guide element, the seat rail is disengaged from the plurality of securing elements.

2. The rowing machine of claim 1, wherein engagement of the plurality of guide elements with the seat rail is dependent upon the position of the seat rail relative to the frame.

3. The rowing machine of claim 1, wherein in the use configuration, at least one of the guide elements is disengaged from the seat rail.

4. The rowing machine of claim 1, wherein engagement of the plurality of securing elements with the seat rail is dependent upon the position of the seat rail relative to the frame.

5. The rowing machine of claim 4, wherein in the storage configuration, at least one of the securing elements is disengaged from the seat rail.

6. The rowing machine of claim 1, wherein:

the plurality of guide elements includes first, second, and third guide elements;

the seat rail includes a first portion;

the first and third guide elements selectively engage the seat rail below the first portion; and the second guide element selectively engages the seat rail above the first portion.

7. The rowing machine of claim 6, wherein:

the first portion includes a first flange comprising opposing first and second surfaces;

the first and third guide elements selectively engage the first surface; and the second guide element selectively engages the second surface.

8. The rowing machine of claim 7, wherein:

the seat rail includes a second flange opposite the first flange;

at least one of the plurality of securing elements selectively engages the first flange; and at least another of the plurality of securing elements selectively engages the second flange.

9. The rowing machine of claim 6, wherein the second guide element is positioned between the first and third guide elements.

10. The rowing machine of claim 1, wherein at least two of the plurality of guide elements are disengaged from the seat rail when the seat rail is positioned for use.

11. The rowing machine of claim 10, wherein each the plurality of guide elements disengages from the seat rail when the seat rail is positioned for use.

12. The rowing machine of claim 1, wherein at least one of the plurality of guide elements is movable to disengage the seat rail from the plurality of securing elements.

13. The rowing machine of claim 12, wherein the at least one of the plurality of guide elements is biased to disengage the seat rail from the plurality of securing elements.

14. The rowing machine of claim 13, wherein the at least one of the plurality of guide elements includes a spring or torsion bar biasing the seat rail to disengage the plurality of securing elements.

15. The rowing machine of claim 1, wherein the adjustment assembly slidably or rollably couples the seat rail to the frame.

16. The rowing machine of claim 15, wherein each of the plurality of guide elements comprises a roller or bushing.

17. The rowing machine of claim 1, wherein the plurality of securing elements frictionally engages a surface of the seat rail to secure the seat rail in position.

18. The rowing machine of claim 1, wherein:

the frame includes a first frame member and a second frame member, which define an area between the first and second frame members; and at least a portion of the seat rail extends within the area when positioned in the storage configuration.

19. The rowing machine of claim 18, wherein:

the area includes a base extending between terminal end portions of the first and second frame members; and in the storage configuration, no portion of the seat rail extends beyond the base of the area.

* * * * *